United States Patent [19]

Gillard

[11] Patent Number: 4,601,407

[45] Date of Patent: Jul. 22, 1986

[54] MULTI-LAYERED CONTAINER

[75] Inventor: David F. Gillard, Surrey, Canada

[73] Assignee: MacMillan Bloedel Limited, Vancouver, Canada

[21] Appl. No.: 632,871

[22] Filed: Jul. 20, 1984

[30] Foreign Application Priority Data

Jan. 19, 1984 [GB] United Kingdom ..... 8401373

[51] Int. Cl.[4] ..... B65D 5/02

[52] U.S. Cl. ..... 220/443; 220/441; 229/6 R; 229/DIG. 4

[58] Field of Search ..... 229/37 R, DIG. 1, DIG. 2, 229/DIG. 4, 16 R, 6 R; 220/441, 443; 206/586

[56] References Cited

U.S. PATENT DOCUMENTS

| | | | |
|---|---|---|---|
| 1,097,390 | 5/1914 | Corwin | 229/DIG. 2 |
| 1,152,844 | 9/1915 | Rexford | 229/37 R |
| 1,524,292 | 1/1925 | Dinsmoor | 229/37 R |
| 1,708,700 | 4/1929 | Maier | 229/37 R |
| 1,758,230 | 5/1930 | Lange | 229/DIG. 4 X |
| 1,973,930 | 9/1934 | Rammer | 220/441 |
| 2,099,936 | 11/1937 | Kieckhefer | 229/DIG. 2 X |
| 2,196,157 | 4/1940 | White | 206/586 X |
| 2,949,151 | 8/1960 | Goldstein | 229/37 R X |
| 3,122,300 | 2/1964 | La Bombard | 229/37 R |
| 3,199,763 | 8/1965 | Anderson | 229/37 R |
| 3,253,768 | 5/1966 | Gjesdal | 229/37 R |
| 3,425,764 | 2/1969 | Budd . | |
| 3,732,790 | 5/1973 | Miyake . | |
| 3,907,193 | 9/1975 | Heller | 229/DIG. 4 X |
| 3,910,485 | 10/1975 | Wandel | 220/441 X |
| 3,919,925 | 11/1975 | Hayama . | |
| 4,087,041 | 5/1978 | Centanni | 220/443 X |
| 4,441,948 | 4/1984 | Gillard . | |

*Primary Examiner*—Allan N. Shoap

*Attorney, Agent, or Firm*—Banner, Birch, McKie & Beckett

[57] ABSTRACT

A multi-layered flat walled bulk storage bin or container is disclosed. The container has crushed corners and at least two opposing bevelled corners which enable the container to be folded flat with no spring back in the folded position. The container comprises a multi-layered sleeve having at least four flat sides with corners between adjacent sides, the sleeve having compressible sheet layers, preferably corrugated board layers, with crushed corners and at least two opposing corners being bevelled corners to allow the sleeve to be collapsed so fully closed corners have adjacent sides substantially parallel without additional force applied.

13 Claims, 19 Drawing Figures

MULTI-LAYERED CONTAINER

Figure 1:
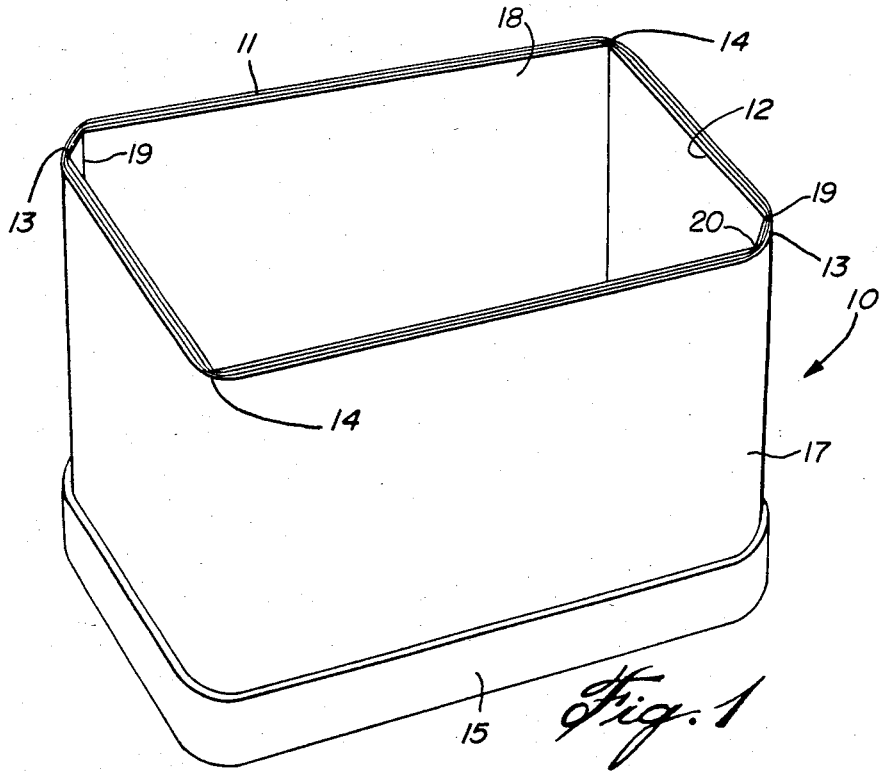

The present invention relates to a multi-layered flat walled bulk storage bin or container made from collapsible or compressible sheet material such as corrugated board. More particularly, the invention relates to a container forced by winding compressible sheet layers to form a sleeve having flat sides with corners between adjacent sides crushing the corners and having at least two opposite corners bevelled to allow the sleeve to be easily collapsed for storing when not in use.

The conventional manner of making multi-layered containers was to glue several corrugated layers together, score a fold line in the appropriate places and then fold the layers to form a sleeve. This method formed a container with a butt joint, where the two ends butt together or a lap joint where the two ends overlap.

Corrugated board containers may also be made by winding corrugated layers about a mandrel with flat sides and glueing each layer to the adjacent layer to form a sleeve. Containers made by this method have no butt or lap joints and therefore use less material than more conventional containers or bulk bins having the same strength properties.

An example of making a container or bulk bin by winding layers about a mandrel is disclosed in our copending U.S. patent application Ser. No. 397,990 filed July 14, 1982 now U.S. Pat. No. 4,441,948. In this method, layers are convolutely wound about a mandrel, the corners of each layer are compressed on the mandrel as the container is wound which results in a container that can be more easily folded for storage purposes after it has been made.

The most obvious corner profile for a container is a right angle, which provides maximum concentration of pressure during the crushing step, thus giving the most efficient means of crushing. However, it has been found that the right angle corner would not fold flat when the corner was folded to the fully closed position and had a spring back which required a counter force to flatten it. It has now been found that a multi-layered sleeve can be made by providing bevels on opposing corners of the sleeve and compressing the layers at these bevelled corners. These crushed bevelled corners avoid the spring back that sometime occurs when the finished sleeves are flattened for storage purposes.

The flattened sleeves provide a distinct advantage for conveying, printing and other processes that are applied to the sleeves after forming.

This foldability is a labour saving feature allowing container sleeves to be folded easily by one person without applying force.

The present invention provides a container comprising a multi-layered sleeve having at least four flat sides with corners between adjacent sides, the sleeve having compressible sheet layers with crushed corners and at least two opposing corners being bevelled corners to allow the sleeve to be collapsed, so fully closed corners have adjacent sides substantially parallel without additional force applied.

The present invention also provides in one embodiment, for the bevelled corners to have an inside bevel width (y), substantially proportional to caliper (x) of the container, where the caliper represents the thickness of the container. In a preferred embodiment, the width (y) is determined according to the formula $y=0.0294+0.347x$, and the width is to the nearest eighth inch.

In other embodiments of the invention, four flat sides are provided with two opposing corners being bevelled corners and the bevels are in the range of about $\frac{1}{4}$ to $\frac{3}{4}$ of an inch wide. The container is preferably made from a flat sheet liner on the inside and multiple layers of single face corrugated sheet wound on the liner. In other embodiments, all the corners of the container are bevelled and caps are provided to fit over the top and the bottom of the sleeve.

The bevelled corners in a preferred embodiment have a flat inside bevelled surface, at an angle of in the range of about 30° to 60°, preferably 45°. In other embodiments, the inside bevelled surface may be multifaceted or curved.

Figure 2:
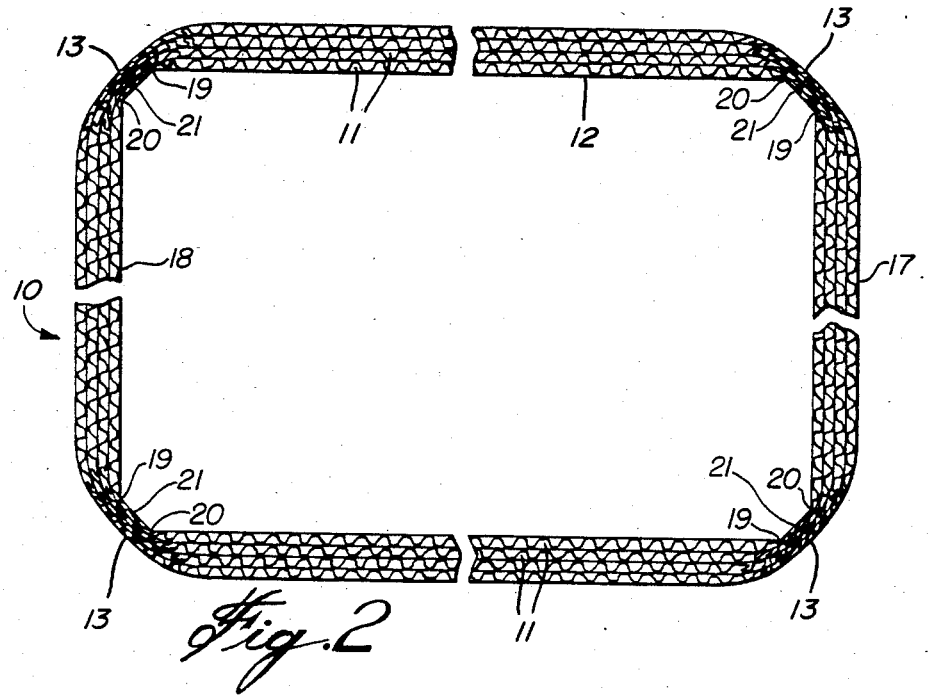
Figure 4:
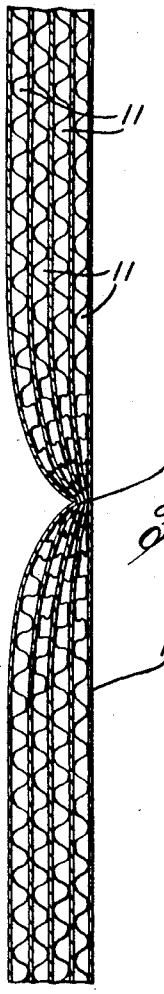
Fig. 4 PRIOR ART
Figure 5:
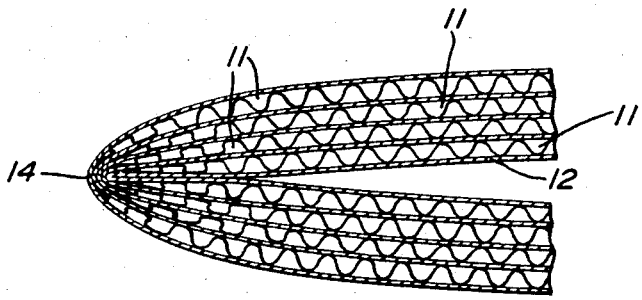
Fig. 5 PRIOR ART
Figure 6:
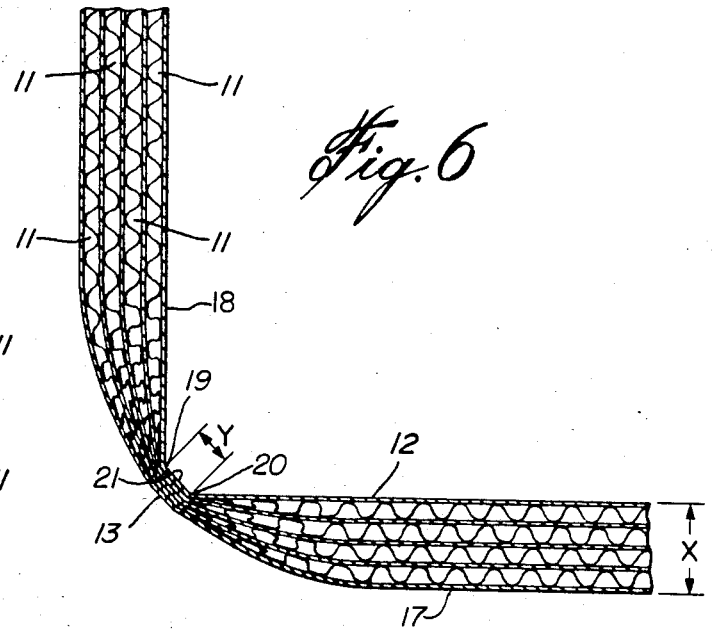
Figure 7:
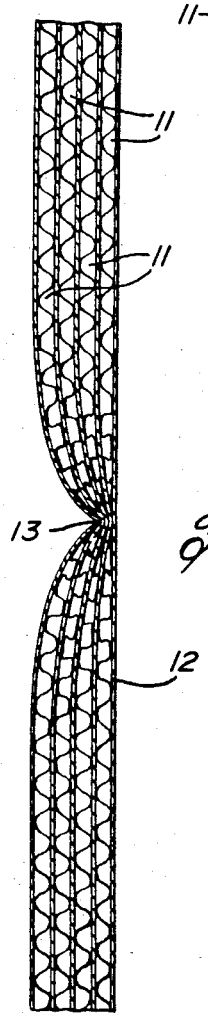
Figure 8:
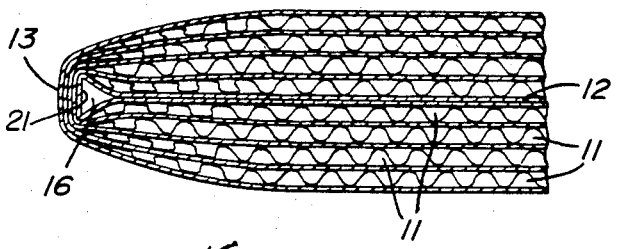
Figure 9:
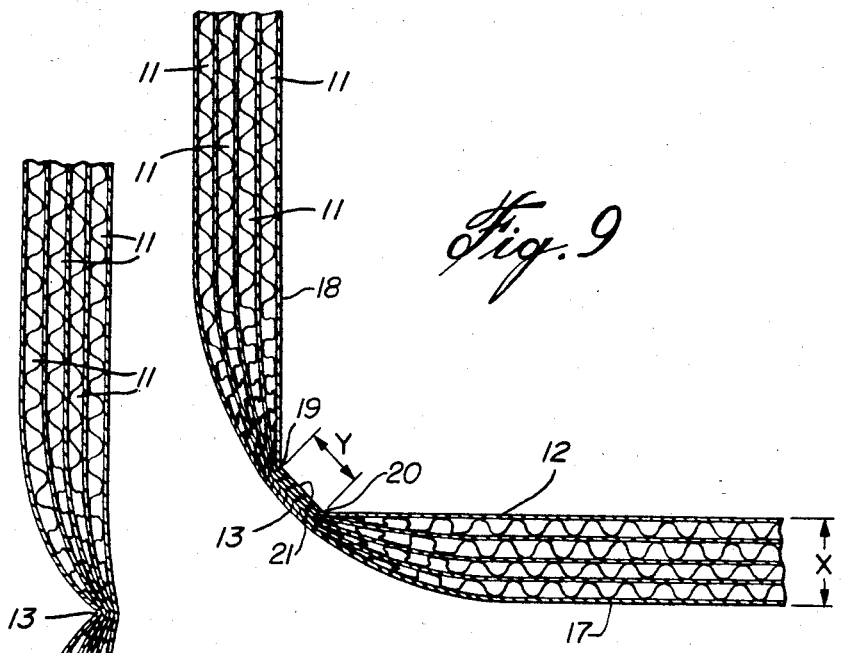
Figure 10:
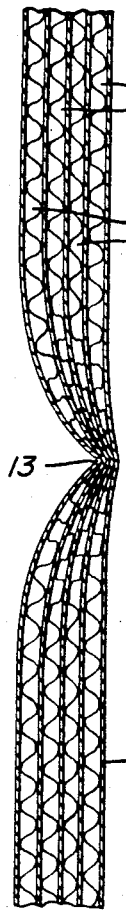
Figure 11:
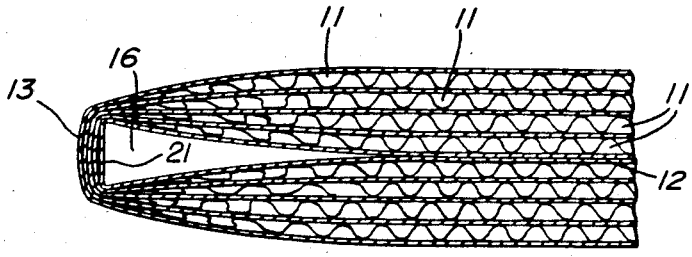
Figure 12:
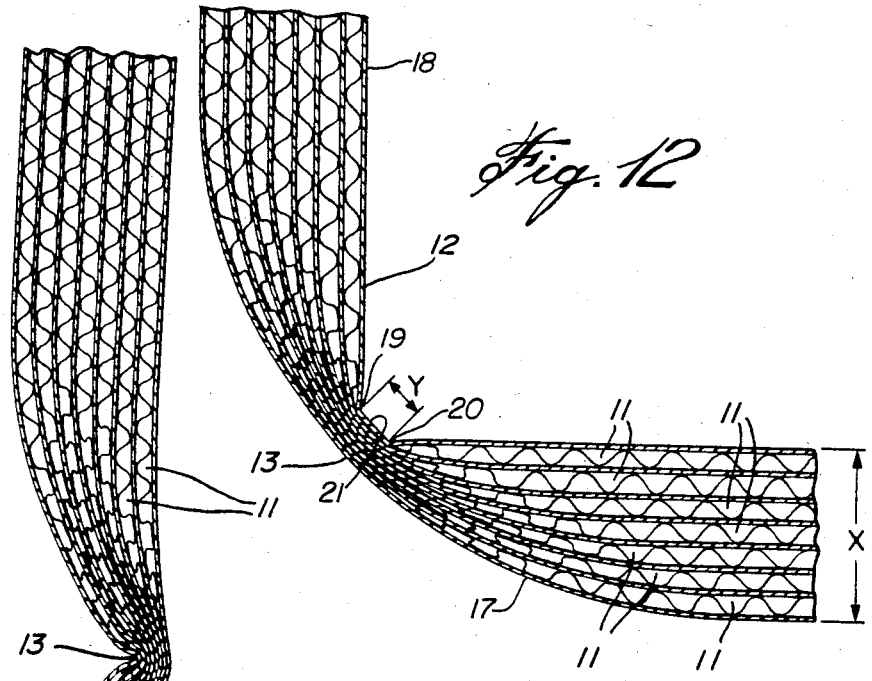
Figure 13:
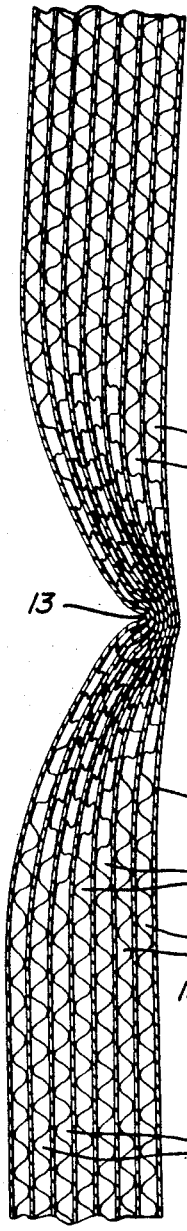
Figure 14:
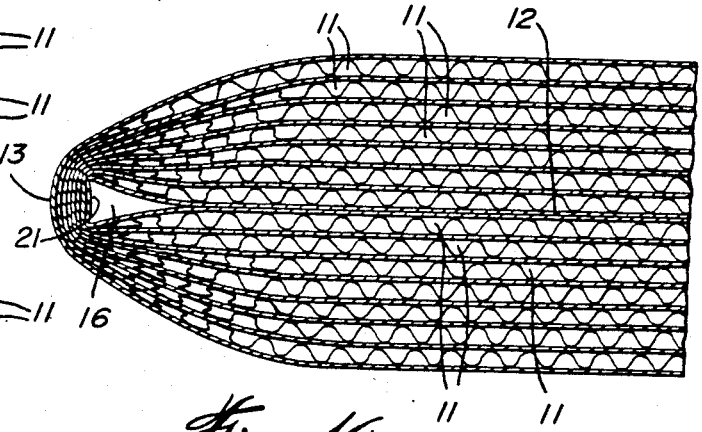
Figure 15:
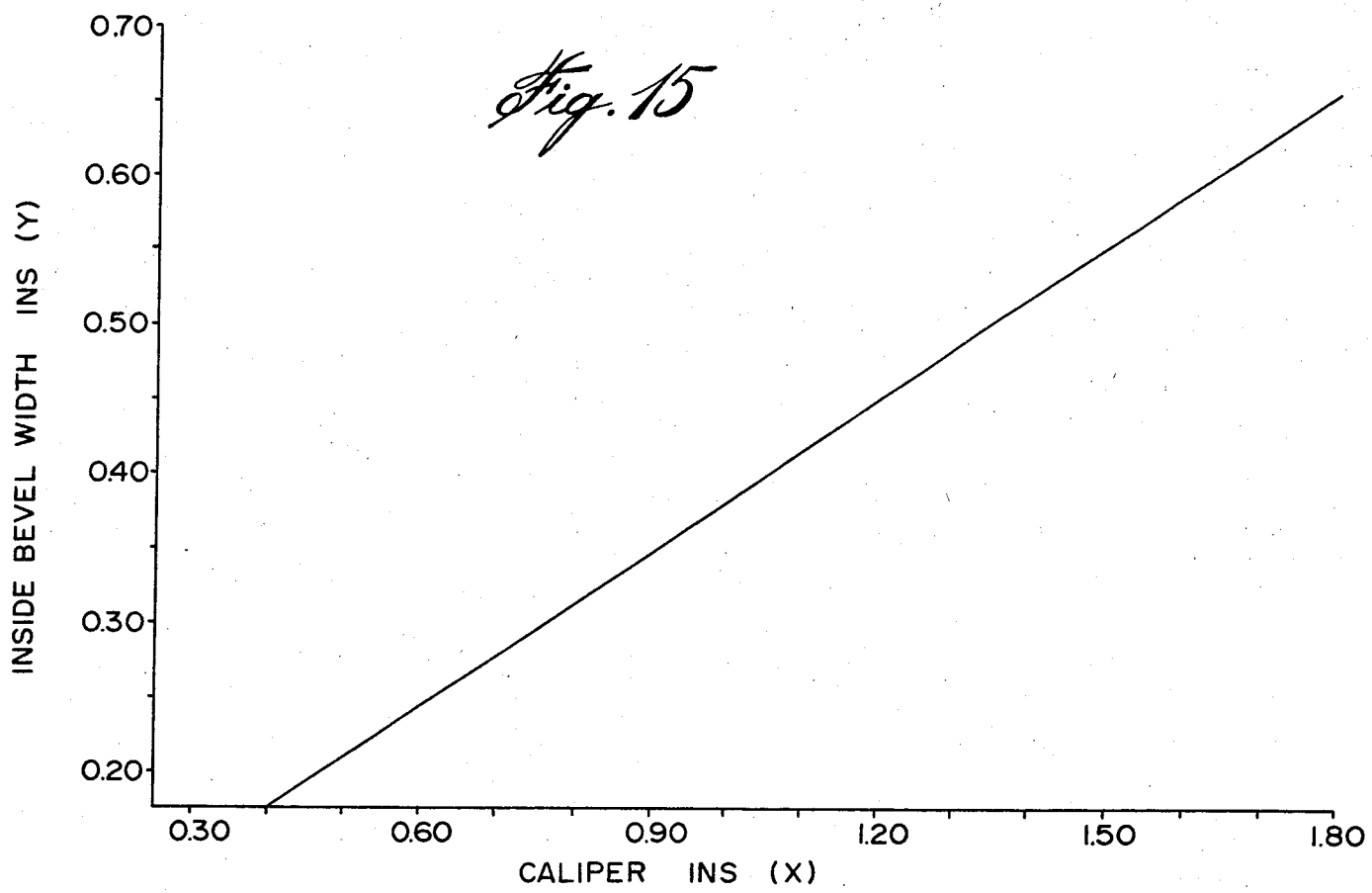

In drawings which illustrate embodiments of the invention,

FIG. 1 is an isometric view of a multi-layered container according to one embodiment of the present invention, FIG. 2 is a top plan view of the container shown in FIG. 1, FIGS. 3, 4 and 5 are detailed plan views showing a right angled corner known in the prior art of a four layered container in the right angled position and fully opened and fully closed folded positions, FIGS. 6, 7 and 8 are detailed plan views showing a preferred bevelled corner of a four layered container in the right angled position and fully opened and fully closed folded positions, FIGS. 9, 10 and 11 are detailed plan views showing a bevelled corner of a four layered container having a wide bevel width, in the right angled position and fully open and fully closed folded positions, FIGS. 12, 13 and 14 are detailed plan views showing a preferred bevelled corner of a seven layered container in the right angled position and fully opened and fully closed folded positions, FIG. 15 is a graph showing the preferred relationship between the inside bevel width (y) and the container caliper (x), FIGS. 16, 17, 18 and 19 are detailed plan views showing different types of bevels.

An example of a container 10 or bulk bin is shown in FIG. 1 having three layers 11 of single face corrugated sheet wrapped around a flat sheet liner 12. Container 10 has four flat sides with an outer surface 17 and an inner surface 18. Whereas a single face corrugated sheet is illustrated in this embodiment, a foam backed paper would also be applicable depending on the requirements of the container 10. Two bevelled corners 13 oppose each other on the container 10 and have crushed layers at each bevelled corner 13. The other two opposing corners 14 are not bevelled but are crushed so that the container can be folded and lie flat.

The thickness of the sides of the container is referred to as the "Caliper", sometimes as the Board Caliper. Although two bevelled corners 13, provided they are opposite, allow easy folding of the container, it is preferred to bevel all four corners because then it does not matter which corners are fully folded, the container folds flat about all corners.

A bottom cap 15 is shown at the bottom of the container 10 which exactly fits around the sleeve in the open position. The cap 15 is made in a conventional manner, generally of not more than two corrugated layers. A top cap (not shown) may be provided to close the container if required. The top cap may be identical in construction to the bottom cap 15.

FIG. 2 shows a four layered container 10 having four sides and having four bevelled corners 13. Each of the bevelled corners 13 is compressed across the bevel from the outer surface 17 to the inner surface 18. Each of the bevels also has two spaced creases 19 and 20 with an inner bevel surface 21 between the creases so that the container 10 may be collpased with either of the pairs of opposing corners opening out to the open or fully closed folded position. Each of the creases 20 and 21 are located directly adjacent to a flat surface of the inner surface 18. Whereas both examples in FIGS. 1 and 2 illustrate containers having four sides, it will be understood that a container may be made with more than four sides.

A six or eight sided container may be made with at least two opposite corners being bevelled corners so that the container could be collapsed with the bevelled corners forming the fully closed folded position.

Figure 3:
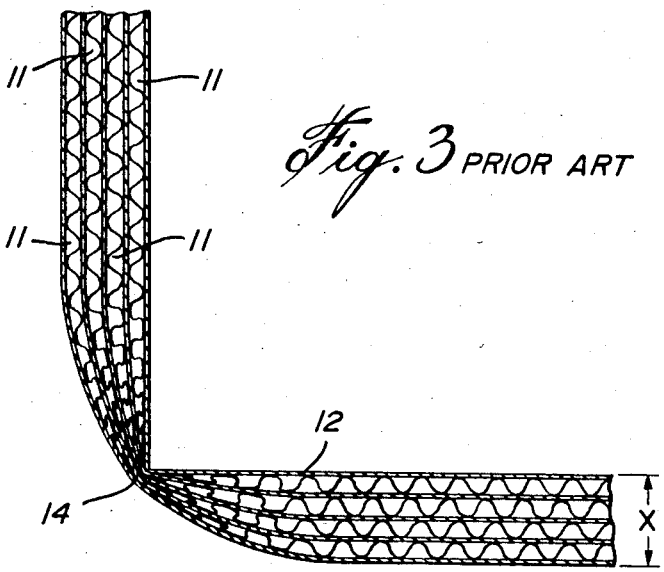
Fig. 3 PRIOR ART

FIGS. 3, 4 and 5 illustrate a right angle corner as is known in the prior art. Four layers 11 of single face corrugated sheet layers are formed about a flat sheet liner 12 and glued to each other to form a container. The corners 14 shown right angled in FIG. 3 are compressed. As can be seen in FIG. 4, when the container is folded flat, the corner 14 opens out to the open position to allow the three layers to bend about the flat sheet liner 12 without causing any delamination of the glued layers or between the first layer 11 and the liner 12.

FIG. 5 illustrates a fully closed folded position of the corner 14, and as can be seen, the corner does not fully fold so the inside flat sheet liner 12 is tapered. To make the two inner surfaces parallel, it is necessary to apply pressure to overcome the spring back force. The inability of the corner to fully fold may result from the liner 12 being pinched together at the corner 14. Forming this type of corner completely closed can result in severe damage and loss of structural integrity to the corner and hence to the container.

FIGS. 6, 7 and 8 illustrate a four layered container with a bevelled corner 13 having a preferred inside bevel width (y), as shown in FIG. 6 in the right angled position. As can be seen, the crushing of the layers 11 from the outer surface 17 to the inner surface 18 extends the crushed portion to not just the bevel but right across the face of the bevel so that there is a predominately flat bevelled surface 21 at the corner of the container, the bevel surface lying between two spaced creases 19 and 20. When the container is folded flat with the bevelled corner fully opened to the opened position, as shown in FIG. 7, the bevel does not appear. However, when the corner is fully closed as can be seen in FIG. 8, the bevel provides a triangular space 16 bounded by the flat bevel surface 21 and the inner surface of the adjacent sides of the container which allows the two inner surfaces of the liner 12 to remain substantially flat and parallel to each other. This is the preferred embodiment of the corner and requires no force on the container to fold flat.

FIGS. 9, 10 and 11 illustrate another example of a bevel, where the inner bevel width is too wide for the caliper of the container. The right angled position shown in FIG. 9 and the fully open position shown in FIG. 10 are satisfactory, but when the corner is in the fully closed position as shown in FIG. 11, the inside surfaces of the liner 12 do not lie flat and parallel to each other, but are tapered in the reverse direction to that shown in FIG. 5 which has no bevel or too small a bevel. This configuration is acceptable for folding as no spring back occurs, and the container lies flat, however it takes up more space, and the space is wasted when the containers are laid flat one upon the other.

FIGS. 12, 13 and 14 illustrate a seven layered container having a preferred inside bevel width (y) as shown in FIG. 12 in the right angled position. FIG. 14 illustrates clearly that the inside surfaces of the liner 12 lie flat and substantially parallel when the corner is in the fully closed position.

To determine the relationship between caliper (x) and inside bevel width (y), a number of tests were carried out on different board calipers for three ply up to ten ply and for different types of corrugated board and it was found that the overall caliper (x) was the key factor, not the different types of ply. The bevel should preferably be flat when the corner was in the fully opened position, and form a triangular space 16 when in the fully closed position. FIG. 15 shows that the relationship between inside bevel width (y) and caliper (x) follows a straight line, and the relationship was according to the formula: $y=0.0294+0.347x$.

It is preferable for ease of manufacture to make the inside width of the bevel to a certain series of fixed increments so that standard mandrels can be used. In one embodiment, the inside bevel widths were made to $\frac{1}{4}''$, $\frac{3}{8}''$, $\frac{1}{2}''$, $\frac{5}{8}''$, $\frac{3}{4}''$. FIGS. 6, 7 and 8 illustrate a $\frac{1}{4}''$ bevel for a container having a caliper of 0.60″.

Figure 16:
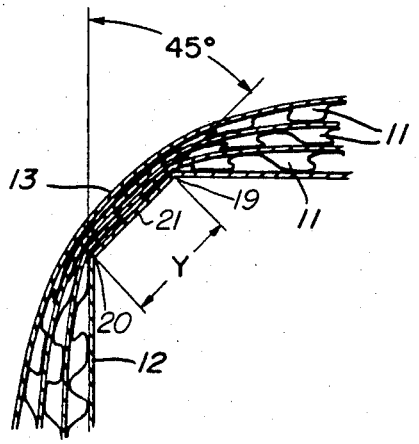
Figure 17:
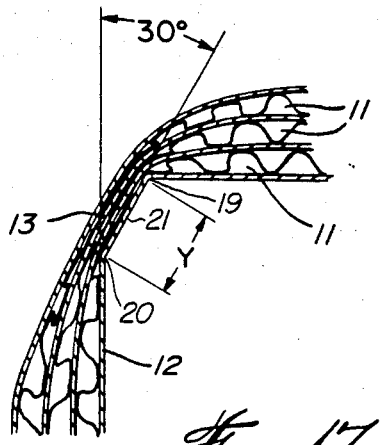
Figure 18:
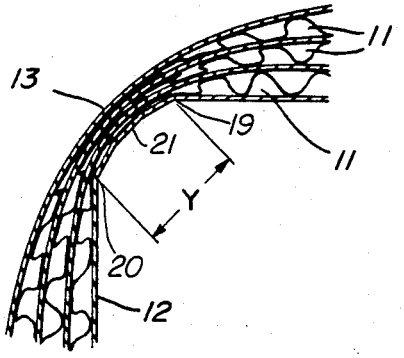
Figure 19:
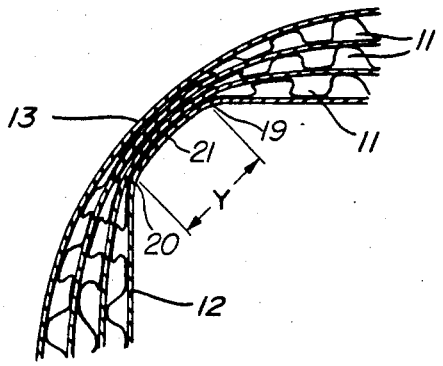

The shape of the bevels are preferably flat on the inside and at an angle of 45° for symmetry as shown in FIG. 16. However a range of angles, from 30° to 60° can be used as shown in FIG. 17. Furthermore a multifaceted bevel as shown in FIG. 18 may be used or a curved bevel as shown in FIG. 19. The bevelled corners 13 in FIGS. 16–19 each have two spaced creases 19 and 20 with an inner bevel surface 21 between the creases. The width of bevel (y) is measured between the points on the adjacent inside faces where a change occurs from the flat surface. This change defines the creases or crease lines 19 and 20. The shape of the bevel is arranged so that the inside of the bevel lies flat when the corner is in the fully open position.

The width of the bevel depends partly on the shape and size of the container and the size and the number of layers. It has been found that up to at least six layers can be formed into a container and the preferred bevel is in the order of $\frac{1}{4}$ inch although bevels of up to $\frac{3}{4}$ of an inch may be applicable in certain cases. The measurements represent the inside face width of the bevel. The bevelled corner gives the correct corner geometry necessary to result in corner creases which are easy to fold.

The unique corner requires less labour and less force to fold the box and results in less spring back from a folded sleeve. Furthermore, the sleeve has superior strength due to structural integrity because the corners are not damaged by folding. When a sleeve is wound on a mandrel, the container has no butt joints or cap joints, therefore there are no areas or weaknesses as in corrugated containers made by conventional methods having butt or lap joints. The sleeve may be trimmed by a sawcut at both edges thus providing a perfectly square sleeve for fitting into a cap 15 as shown in FIG. 1. The layered container also provides a superior panel rigidity and thus better resists bulging.

The bevelled corners can be utilized with containers made by crushing the corners after the container has been formed, known as "post" crushing or in the case where layers are wound about a mandrel, each layer is crushed as it is wound in accordance with co-pending U.S. patent application Ser. No. 397,990 now U.S. Pat. No. 4,441,948 known as "continuous" crushing.

Various changes may be made without departing from the scope of the present invention which is limited only by the following claims.

The embodiments of the invention in which an exclusive property or privilege is claimed are defined as follows:

1. A container comprising a sleeve of multiple layers of compressible material made by winding a compressible sheet layer around a mandrel, said sleeve having an outer surface and an inner surface and said sleeve having at least four flat sides with crushed corners between adjacent sides, said corners crushed from said outer surface to said inner surface, at least two opposing corners of said sleeve being bevelled corners, each of said bevelled corners having two spaced creases on the inner surface of the sleeve and an inner bevel surface between said creases, said beveled corners being crushed across the full width of said inner bevel surface, said creases each comprising a single line, each of said crease located directly adjacent to a flat inner surface of said sleeve, each inner bevel surface and associated creases together being substantially planar, and characterized wherein a triangular space bounded by said inner bevel surface and the inner surface of the adjacent sides of said sleeve is formed at each bevelled corner when each corner is in a fully closed position to allow the sleeve to be collapsed so fully closed folded corners have adjacent sides substantially parallel and in contact without substantial force applied.

2. The container according to claim 1 wherein the bevelled corners have an inside bevel width (y) substantially proportional to caliper (x) of the container.

3. The container according to claim 2 wherein the width (y) is determined according to the formula $y=0.0294+0.347x$.

4. The container according to claim 3 wherein the width (y) is selected from the nearest one eighth inch increments of the result using said formula.

5. The container according to claim 1 having four flat sides with two opposing corners being bevelled corners.

6. The container according to claim 1 wherein the bevelled corners are in the range of about $\frac{1}{4}$ to $\frac{3}{4}$ of an inch wide.

7. The container according to claim 1 including a flat sheet liner on the inside of the sleeve and multiple layers of single face corrugated sheet wound on the liner.

8. The container according to claim 1 having four flat sides with all corners being bevelled corners.

9. The container according to claim 1 including caps provided to fit over the top and bottom of the sleeve.

10. The container according to claim 1 wherein the bevelled corners have a flat inside bevel surface at an angle in the range of about 30° to 60°.

11. The container according to claim 10 wherein the bevelled corners have a flat inside bevel surface at an angle of about 45°.

12. The container according to claim 1 wherein the bevelled corners have a multi-faceted inside bevel surface.

13. The container according to claim 1 wherein the bevelled corners have a curved inside bevel surface.

* * * * *